US009057980B2

(12) United States Patent
Koakutsu

(10) Patent No.: US 9,057,980 B2
(45) Date of Patent: Jun. 16, 2015

(54) TONER TRANSPORT STRUCTURE AND IMAGE FORMING APPARATUS

(71) Applicant: FUJI XEROX CO., LTD., Minato-ku, Tokyo (JP)

(72) Inventor: Masafumi Koakutsu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 49 days.

(21) Appl. No.: 13/902,222

(22) Filed: May 24, 2013

(65) Prior Publication Data

US 2014/0105650 A1 Apr. 17, 2014

(30) Foreign Application Priority Data

Oct. 17, 2012 (JP) ..... 2012-230181

(51) Int. Cl.
*G03G 15/08* (2006.01)

(52) U.S. Cl.
CPC ..... *G03G 15/0832* (2013.01); *G03G 15/0879* (2013.01); *G03G 2215/0678* (2013.01); *G03G 15/0865* (2013.01)

(58) Field of Classification Search
None
See application file for complete search history.

(56) References Cited

U.S. PATENT DOCUMENTS

2008/0253804 A1* 10/2008 Furuta et al. ..... 399/119
2012/0263502 A1* 10/2012 Nakaue et al. ..... 399/254

FOREIGN PATENT DOCUMENTS

JP 2008-083287 A 4/2008
JP 2008-287214 A 11/2008

* cited by examiner

*Primary Examiner* — Roy Y Yi
(74) *Attorney, Agent, or Firm* — Sughrue Mion, PLLC

(57) ABSTRACT

A toner transport structure has a transport passage that extends in an intersecting direction that intersects a vertical direction. The toner transport structure includes a path member that has an upper end and a lower end, an exit on a lower end side thereof, and an entrance on an upper end side thereof. The exit and the entrance have respective openings, and the path member guides toner downward in the vertical direction. The toner transport structure also includes a transport member disposed in the transport passage that is connected to the exit on the lower end side of the path member. The transport member transports along the transport passage the toner having been guided downward by the path member. In the toner transport structure, an area of the opening at the exit is larger than an area of the opening at the entrance.

6 Claims, 7 Drawing Sheets

TONER TRANSPORT STRUCTURE AND IMAGE FORMING APPARATUS

CROSS-REFERENCE TO RELATED APPLICATIONS

This application is based on and claims priority under 35 USC 119 from Japanese Patent Application No. 2012-230181 filed Oct. 17, 2012.

BACKGROUND

Technical Field

The present invention relates to a toner transport structure and an image forming apparatus.

SUMMARY

A toner transport structure according to an aspect of the present invention has a transport passage that extends in an intersecting direction that intersects a vertical direction. The toner transport structure includes a path member that has an upper end and a lower end, an exit on a lower end side thereof, and an entrance on an upper end side thereof. The exit and the entrance have respective openings, and the path member guides toner downward in the vertical direction. The toner transport structure also includes a transport member disposed in the transport passage that is connected to the exit on the lower end side of the path member. The transport member transports along the transport passage the toner having been guided downward by the path member. In the toner transport structure, an area of the opening at the exit is larger than an area of the opening at the entrance.

BRIEF DESCRIPTION OF THE DRAWINGS

Exemplary embodiment of the present invention will be described in detail based on the following figures, wherein.

DETAILED DESCRIPTION

Examples of a toner transport structure according to an exemplary embodiment of the present invention and an example of an image forming apparatus equipped with the toner transport structure will be described below with reference to FIGS. 1 to 7. In FIGS. 1 to 7, arrow V indicates the vertical direction, arrow H indicates a direction which is the horizontal direction and an apparatus width direction (left-right direction of the apparatus), and arrow D indicates a direction which is the horizontal direction and an apparatus depth direction.

General Structure

Figure 6:
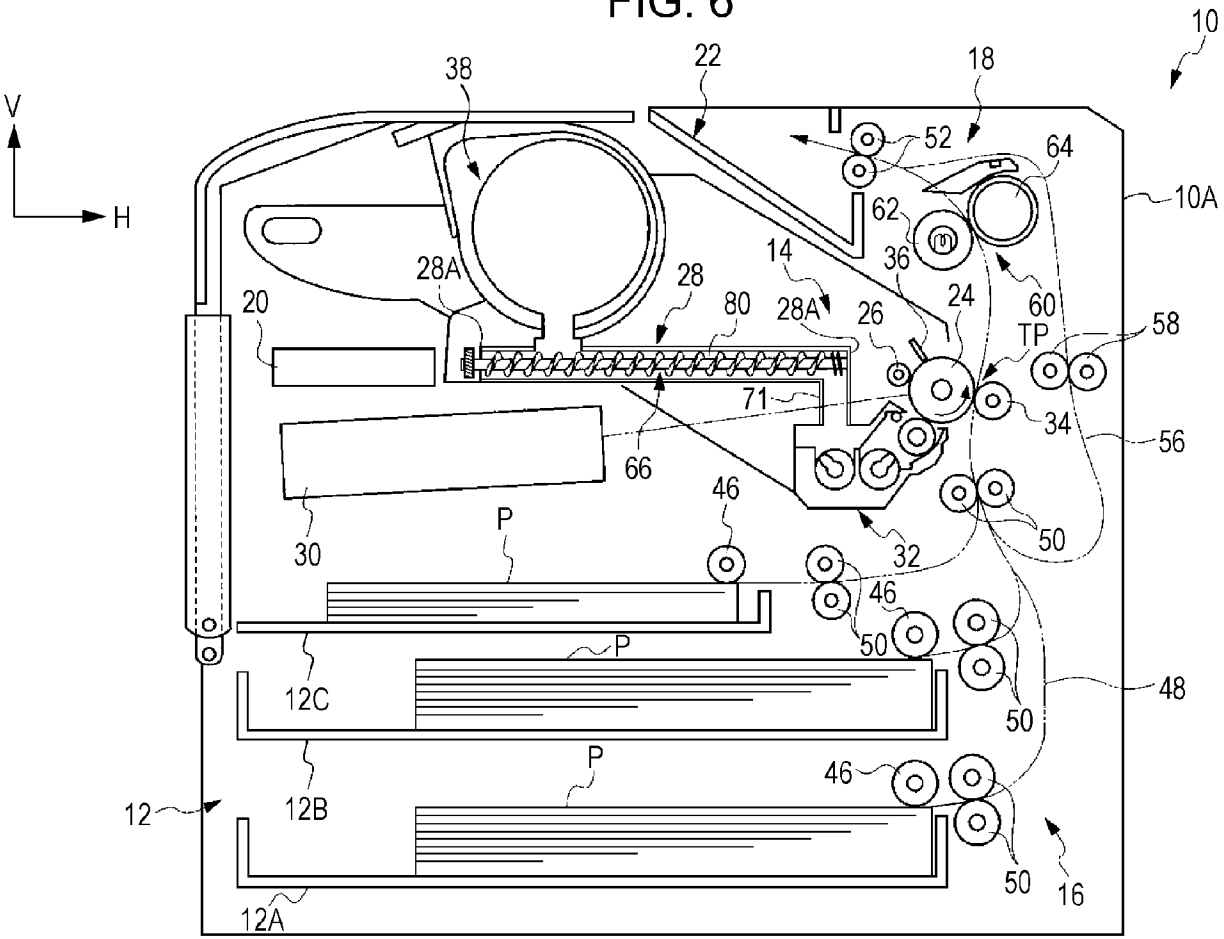
FIG. 6 illustrates a general structure of an image forming apparatus according to the exemplary embodiment of the present invention.

As illustrated in FIG. 6, an image forming apparatus 10 includes an apparatus body 10A that houses components of the image forming apparatus 10 therein. A container section 12, a transport section 16, an image forming section 14, a fixing unit 18, and a controller 20 are provided in the apparatus body 10A. The container section 12 contains a sheet medium P serving as a recording medium. The transport section 16 transports the sheet medium P contained in the container section 12. The image forming section 14 forms a toner image on the sheet medium P being transported. The fixing unit 18 fixes onto the sheet medium P the toner image having been formed on the sheet medium P by the image forming section 14. The controller 20 controls operations of the components of the image forming apparatus 10.

An output unit 22 is formed in an upper portion of the apparatus body 10A. The sheet medium P, onto which an image has been fixed by the fixing unit 18, is ejected to the output unit 22.

Image Forming Section

The image forming section 14 is disposed near the center in the up-down direction in the apparatus body 10A. The image forming section 14 includes an image carrying body 24 that holds an image.

The image carrying body 24 has a cylindrical shape and is rotated in a single direction (counterclockwise in FIG. 6). A charging roller 26, an exposure device 30, a developing device 32, and a transfer roller 34 are disposed around the image carrying body 24 in order from an upstream side in the rotational direction of the image carrying body 24. The charging roller 26 charges the image carrying body 24. The exposure device 30 exposes the image carrying body 24, which has been charged by the charging roller 26, with light so that an electrostatic latent image is formed on the image carrying body 24. The developing device 32 develops the electrostatic latent image formed by the exposure device 30 with a developer G that contains a toner T and carrier, thereby forming, for example, a black toner image. The transfer roller 34 transfers the black toner image having been formed on the image carrying body 24 by the developing device 32 onto the sheet medium P.

Furthermore, a collection blade 36 is provided so as to be in contact with an outer circumferential surface of the image carrying body 24. The collection blade 36 collects the toner T that has not been transferred onto the sheet medium P by the transfer roller 34 and remains on the image carrying body 24.

The transfer roller 34 opposes the image carrying body 24. The transfer roller 34 and the image carrying body 24 pinch the sheet medium P therebetween while being rotated so that the sheet medium P is transported from a lower side to the upper side. A transfer position TP, where the toner image formed on the image carrying body 24 is transferred onto the sheet medium P, is defined at a nip between the transfer roller 34 and the image carrying body 24.

A toner cartridge 38 that contains toner is disposed above the exposure device 30. A transport pipe 28 is provided in the image forming section 14. The transport pipe 28 transports the toner T contained in the toner cartridge 38 to the developing device 32. The details of the structures of the toner cartridge 38 and the transport pipe 28 will be described later.

Containing Section

The container section 12 is disposed below the image forming section 14. The container section 12 includes loading members 12A, 12B, and 12C arranged in the up-down direction. The sheet media P are loaded in the loading members 12A, 12B, and 12C. Each of the loading members 12A, 12B, and 12C may be drawn toward the apparatus front side in the apparatus depth direction. When the loading members 12A, 12B, and 12C are drawn to the apparatus front side, the loading members 12A, 12B, and 12C may be replenished with the sheet media P.

Transport Section

The transport section 16 is disposed beside the container section 12 and the image forming section 14. The transport section 16 includes pickup rollers 46 and transport rollers 50. An uppermost sheet medium P loaded in each of the loading members 12A, 12B, and 12C is fed by a corresponding one of the pickup rollers 46. The sheet medium P fed by a corresponding one of the pickup rollers 46 is transported along a transport path 48 for the sheet medium P by the plural transport rollers 50.

The transport section 16 also includes ejection rollers 52 that eject each sheet medium P, onto which a toner image has been fixed by the fixing unit 18, to the output unit 22.

The transport section 16 further includes transport rollers 58. The transport rollers 58 transport the sheet medium P along an inversion transport path 56 so that the front and back sides of the sheet medium P, onto one side (front side) of which a toner image has been fixed, is inverted and so that the sheet medium P is transported again to the transfer position TP.

The inversion transport path 56 is disposed on one side of the transfer roller 34 opposite to the other side of the transfer roller 34 where the image carrying body 24 is disposed. When images are formed on both sides of the sheet medium P, the sheet medium P, onto one side of which a toner image has been fixed, is transported backward by the ejection rollers 52 and guided to the inversion transport path 56. The front and back sides of the sheet medium P are inverted by being transported along the inversion transport path 56 by the transport rollers 58. The inverted sheet medium P is transported again to the transfer position TP.

Fixing Unit

The fixing unit 18 is disposed above the image forming section 14. The fixing unit 18 includes a fixing device 60. The fixing device 60 includes a heating roller 62 and a pressure roller 64. The heating roller 62 heats a toner image transferred onto the sheet medium P while being rotated by a rotational force transmitted thereto from a motor (not shown). The pressure roller 64 is in contact with the heating roller 62 and rotated (revolved) by the heating roller 62. The pressure roller 64 and the heating roller 62 transport the sheet medium P while pinching the sheet medium P therebetween.

Operation of General Structure

Next, image forming operations in which an image is formed on the sheet medium P are described.

In the container section 12 and the transport section 16, the sheet medium P fed from one of the loading members 12A, 12B, and 12C by the pickup rollers 46 is transported to the transfer position TP using the plural transport rollers 50.

In the image forming section 14, the image carrying body 24 is charged by the charging roller 26, and then exposed to light by the exposure device 30, thereby an electrostatic latent image is formed on the image carrying body 24. The electrostatic latent image is developed by the developing device 32 so as to form a black toner image on the image carrying body 24. The black toner image is transferred onto the sheet medium P having been transported to the transfer position TP by the transfer roller 34.

The sheet medium P, onto which the toner image has been transferred, is transported to the fixing device 60. The toner image having been transferred onto the sheet medium P is fixed onto the sheet medium P by the fixing device 60. In the case in which an image is formed only on one side of the sheet medium P, the sheet medium P is ejected to the output unit 22 by the ejection rollers 52 after the toner image has been fixed onto the sheet medium P.

In contrast, in the case where images are formed on both sides of the sheet medium P, the sheet medium P, onto one side (front side) of which a toner image has been fixed, is transported backward by the ejection rollers 52 to the inversion transport path 56. By transporting the sheet medium P along the inversion transport path 56 using the transport rollers 58, the front and back sides of the sheet medium P are inverted. The sheet medium P is again transported to the transfer position TP from the inversion transport path 56, and a toner image is formed on the back side of the sheet medium P, onto which no toner image has been formed, in a way similar to the way in which the toner image has been formed on the front side. Then, the sheet medium P is ejected to the output unit 22 by the ejection rollers 52. A series of image forming operations are performed as stated above.

Detailed Structure

Next, in order to describe a toner transport structure 78, which transports the toner T in an intersecting direction that intersects the vertical direction, the structures of the toner cartridge 38, the transport pipe 28, and the like are initially described.

The toner cartridge 38 has a cylindrical shape. Opening a maintenance door (not shown), which is provided in the apparatus body 10A, so as to open the interior of the apparatus body 10A to the outside of the apparatus body 10A allows the user to draw the toner cartridge 38 toward the apparatus front side in the apparatus depth direction. Then, the toner cartridge 38 is detached from the apparatus body 10A by being drawn toward the apparatus front side by the user.

In this structure, when the toner cartridge 38 runs short of the toner T contained therein due to supplying the toner T to the developing device 32 through the transport pipe 28, the user detaches the toner cartridge 38 attached to the apparatus body 10A from the apparatus body 10A. Then, when the user causes a new toner cartridge 38 to oppose a toner cartridge attachment portion and moves the toner cartridge 38 toward the rear side of the apparatus in the apparatus depth direction, the new toner cartridge 38 is attached to the apparatus body 10A.

Toner Cartridge

Figure 5:
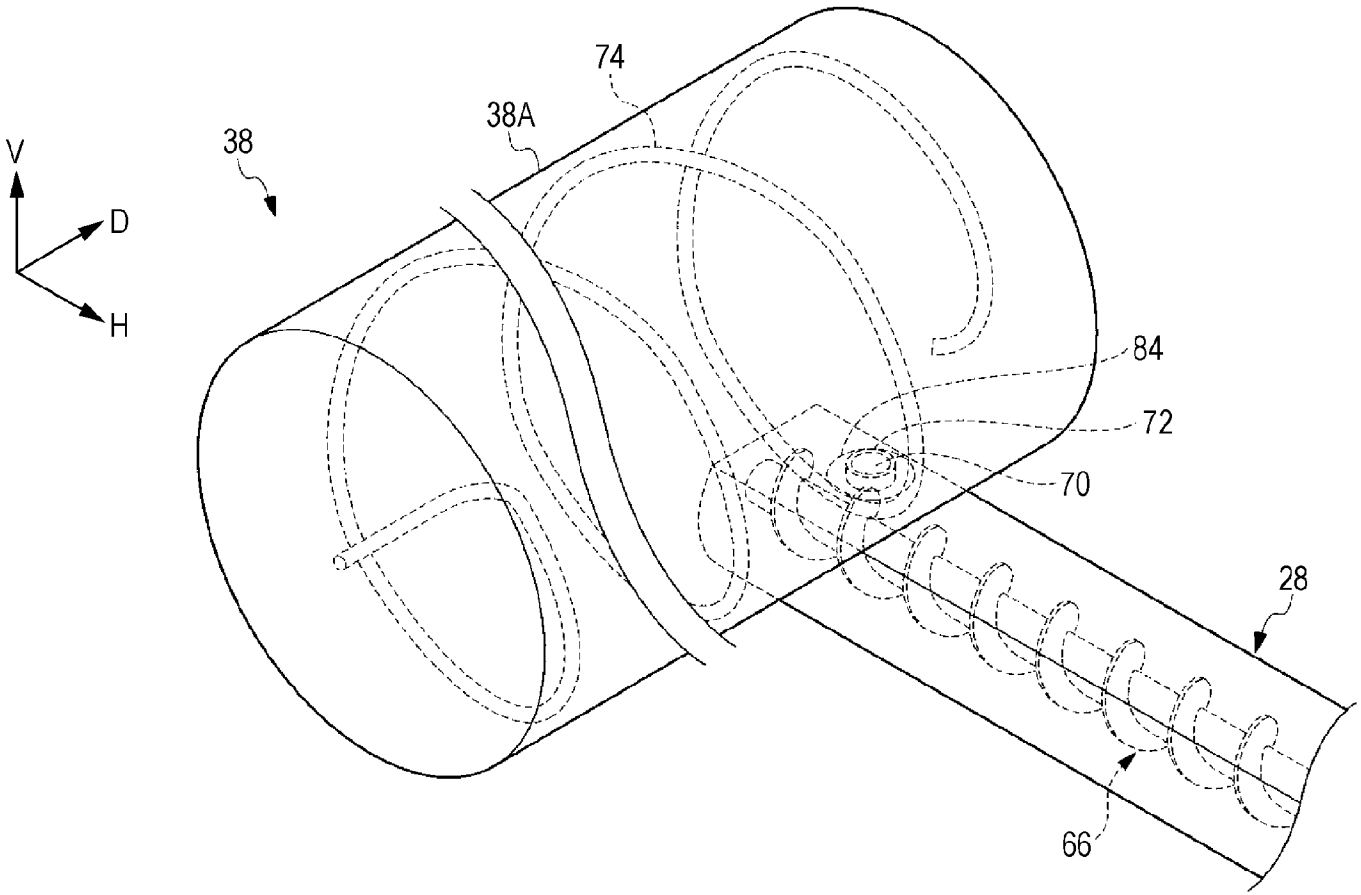
FIG. 5 is a perspective view illustrating the toner transport structure according to the exemplary embodiment of the present invention.

As illustrated in FIG. 5, the toner cartridge 38 that contains the toner T therein has a cylindrical shape that extends in the apparatus depth direction. An outlet path 70, through which the toner T contained in the toner cartridge 38 is transported to the transport pipe 28, is formed in a lower surface of a housing 38A on the rear side of the apparatus in the apparatus depth direction. The housing 38A defines a housing of the toner cartridge 38. The details of the outlet path 70 will be described later.

A spiral-shaped agitator 74 is disposed in the housing 38A. The agitator 74 is rotated by a rotational force transmitted thereto from a drive source (not shown) and transports the toner T in the housing 38A toward the outlet path 70 while agitating the toner T.

Transport Pipe

The transport pipe 28 is disposed below the toner cartridge 38. The transport pipe 28 receives the toner T from the toner cartridge 38 through the outlet path 70 and an inlet path 82, which will be described later, and supplies the received toner T to the developing device 32. Specifically, as illustrated in FIG. 6, the transport pipe 28 extends in the intersecting direction (a direction that matches an apparatus width direction in the present exemplary embodiment) that intersects the vertical direction so as to be directed from the lower side of the toner cartridge 38 toward the developing device 32.

Figure 2:
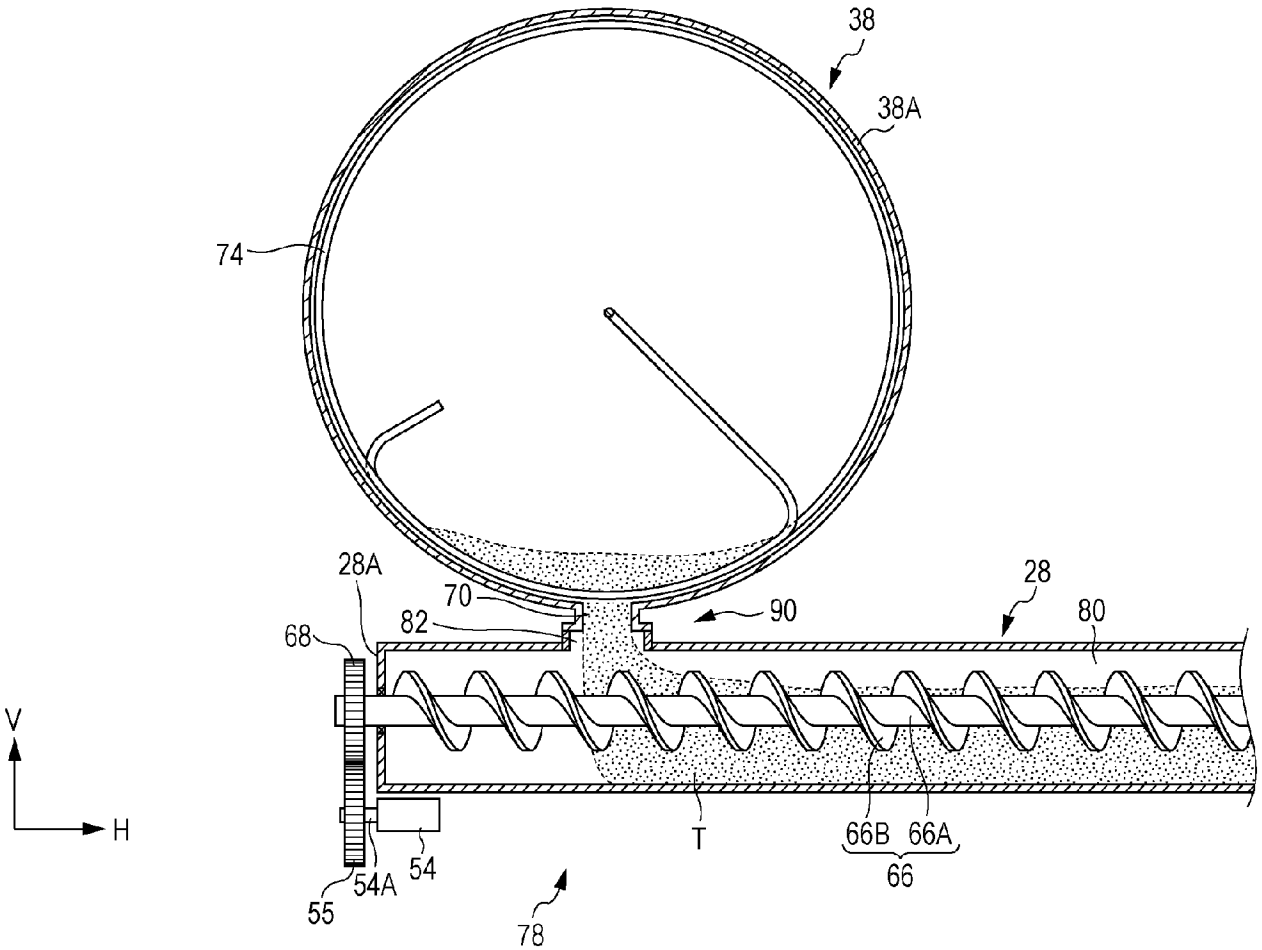
FIG. 2 is a sectional view illustrating the toner transport structure according to the exemplary embodiment of the present invention.

As illustrated in FIGS. 2 and 6, a transport passage 80 is defined inside the transport pipe 28 that extends in the intersecting direction. The toner T is transported to the developing device 32 through the transport passage 80. A transport auger 66 is disposed in the transport passage 80. The transport auger 66 serves as an example of a transport member that transports the toner T having been guided downward through the outlet path 70 and the inlet path 82 from one end side (toner cartridge 38 side) of the transport passage 80 to the other end side (developing device 32 side) of the transport passage 80 along the transport passage 80. Hereafter, also for parts or the like other than the transport passage 80, with respect to the intersecting direction, the toner cartridge 38 side and the developing device 32 side may be respectively referred to as a one end side and the other end side.

The transport auger 66 has a cylindrical shaft portion 66A and a spiral-shaped blade portion 66B, which is integrally formed with the shaft portion 66A on an outer circumferential surface of the shaft portion 66A. The transport auger 66 is rotatably supported by a pair of closing lids 28A that close one and the other end portions of the transport pipe 28.

As illustrated in FIG. 2, the one end side of the shaft portion 66A protrudes from one of the closing lids 28A to the outside. A gear 68 is attached to the protruding portion of the shaft portion 66A. The gear 68 is engaged with a gear 55, which is secured to an output shaft 54A of a motor 54.

Furthermore, as illustrated in FIG. 6, the transport pipe 28 has an open portion in a lower surface thereof on the other end side. An upper end portion of a connection pipe 71 is attached to this open portion. A lower end portion of the connection pipe 71 is connected to the developing device 32.

In this structure, a rotational force is transmitted to the transport auger 66 via the gear 55 and the gear 68 when the controller 20 causes the motor 54 (see FIG. 2) to operate. The toner T is transported from the one end side to the other end side of the transport passage 80 by the rotation of the transport auger 66, and accordingly, the toner T is supplied to the developing device 32 through the connection pipe 71.

Path Member

Figure 1:
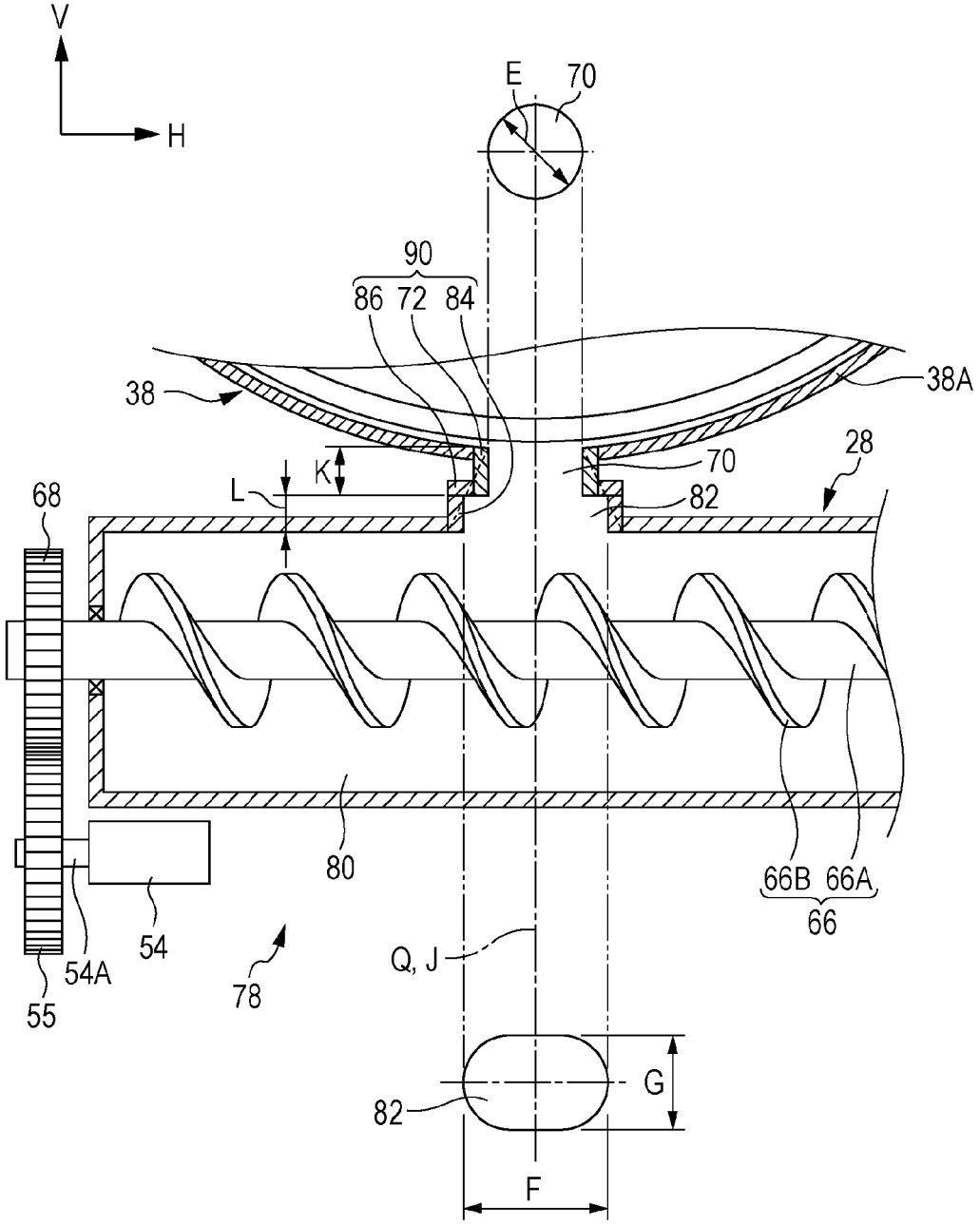
FIG. 1 is an enlarged sectional view illustrating a toner transport structure according to an exemplary embodiment of the present invention.

As illustrated in FIG. 5, a cylindrical outlet member 72 is attached to the lower surface of the housing 38A of the toner cartridge 38 on the rear side of the apparatus in the apparatus depth direction. As illustrated in FIG. 1, the circular outlet path 70, through which the toner T contained in the housing 38A is transported to the transport pipe 28, is formed by the outlet member 72.

The inlet path 82, through which the transport pipe 28 receives the toner T from the toner cartridge 38 through the outlet path 70, is formed on the one end side in an upper surface of the transport pipe 28.

Specifically, a cylindrical inlet member 84, which extends in the intersecting direction, is attached to the upper surface of the transport pipe 28, thereby forming the inlet path 82 having an elongated hole shape (slot shape). The dimension in the short side direction (dimension "G" in FIG. 1) of the inlet path 82 having an elongated hole shape is substantially the same as that of the diameter of the circular outlet path 70 (diameter "E" in FIG. 1).

A step member 86 is disposed between a lower end of the outlet member 72 and an upper end of the inlet member 84. The step member 86 defines a step between the lower end of the outlet member 72 and the upper end of the inlet member 84.

The step member 86, the outlet member 72, and the inlet member 84 define a path member 90. The toner T in the housing 38A is guided downward in the vertical direction by the path member 90.

As understood from the above description, an inner circumferential wall of the path member 90 is enlarged stepwise. The area of an opening at an exit on a lower end side of the path member 90 is larger than the area of an opening at an entrance on an upper end side of the path member 90.

As described above, the toner transport structure 78 guides the toner T downward in the vertical direction and transports the toner T in the intersecting direction that intersects the vertical direction. The toner transport structure 78 includes the path member 90 and the transport auger 66 and has the transport passage 80.

Operation of Structure

Next, operations of the structure are described.

When the developing device 32 runs short of the toner T, the controller 20 (see FIG. 6) causes the drive source (not shown) to operate so as to transmit a rotational force to the agitator 74 (see FIG. 5) in the housing 38A. Furthermore, as illustrated in FIG. 2, the controller 20 causes the motor 54 to operate so as to transmit a rotational force to the transport auger 66 via the gear 55 and the gear 68.

When the agitator 74 is rotated, the toner T in the housing 38A is agitated while being transported toward the outlet path 70. The toner T having been transported to the outlet path 70 by the agitator 74 is, as illustrated in FIG. 2, delivered to the transport passage 80 through the outlet path 70 and the inlet path 82, which are defined by the path member 90.

The toner T having been received by the transport passage 80 is transported from the one end side to the other end side of the transport passage 80 by the transport auger 66 being rotated. The toner T having been transported to the other end side of the transport passage 80 by the transport auger 66 is supplied to the developing device 32 through the connection pipe 71 (see FIG. 6).

Here, the toner T having been guided downward in the vertical direction by the path member 90 is transported by the transport auger 66 in the intersecting direction that intersects the vertical direction. That is, the transport direction of the toner T is changed. Thus, agglomeration of the toner T may occur due to degradation of toner transport performance at a position where the toner T transport direction is changed.

However, the area of the opening at the exit on the lower end side of the path member 90 is larger than the area of the opening at the entrance on the upper end side of the path member 90. That is, the amount of the toner T that enters the outlet path 70 is smaller than (reduced compared to) the amount of the toner T allowed to pass through the inlet path 82.

Thus, even in the case where toner T transport efficiency is degraded when the toner T transport direction is changed, agglomeration of the toner T caused by degradation of the toner T transport performance is suppressed compared to the case where the amount of the toner T that enters the outlet path 70 is similar to the amount of the toner T allowed to pass through the inlet path 82.

In other words, in a toner transport path in which the toner T transport direction is changed, degradation of toner T transport performance is suppressed compared to the case where, in the path member 90, the area of the opening at the entrance is substantially the same as the area of the opening at the exit.

In particular, nowadays, as the size of the particles of the toner T has been decreasing, the number of points per unit of volume, the points being points where the toner particles are in contact with one another, increases. This increases the effect produced by degradation of the toner T transport performance, and as a result, agglomeration of the toner T may occur during transportation. However, by using the structure according to the present exemplary embodiment, degradation of toner T transport performance is suppressed, and accordingly, agglomeration of the toner T during transportation is suppressed.

Since the inner circumferential wall of the path member 90 is enlarged stepwise, in comparison with the case where the inner circumferential wall of the path member 90 is enlarged so as to have an inverted funnel shape (dotted lines in FIG. 1), the volume of the path member 90 is increased near the exit of the path member 90. Thus, the toner T having entered the path member 90 is loosened near the exit of the path member 90. As a result, in comparison with the case where the inner circumferential wall of the path member 90 is enlarged so as to have an inverted funnel shape, in the toner transport path in which the toner T transport direction is changed, degradation of toner T transport performance is suppressed.

Also, since degradation of toner T transport performance is suppressed, time required for maintenance of the image forming apparatus 10 is reduced.

Evaluation

Here, the toner T transport performance is evaluated by using the above-described toner transport structure 78. Specifically, plural examples and a comparative example are evaluated in terms of toner T transport performance. In the plural examples, the shapes of the outlet path 70 and the inlet path 82, which are formed by the path member 90, are different from one another.

First Example

In a first example, as illustrated in FIG. 1, the diameter (dimension E in FIG. 1) of the circular outlet path 70 is set to 17 mm. In the elongated (slot-shaped) inlet path 82, the dimensions in the long side direction (in the intersecting direction, dimension F in FIG. 1) and in the short side direction (dimension G in FIG. 1) are respectively set to 26 mm and 17 mm. The positional relationship between the outlet member 72 and the inlet member 84 are determined such that the center line Q of the inlet path 82 is coincident with the center line J of the outlet path 70.

The height of the outlet member 72 (dimension K in FIG. 1: length of the outlet path 70) is set to 5 mm, and the height of the inlet member 84 (dimension L in FIG. 1: length of the inlet path 82) is set to 4 mm.

Second Example

Figure 3:
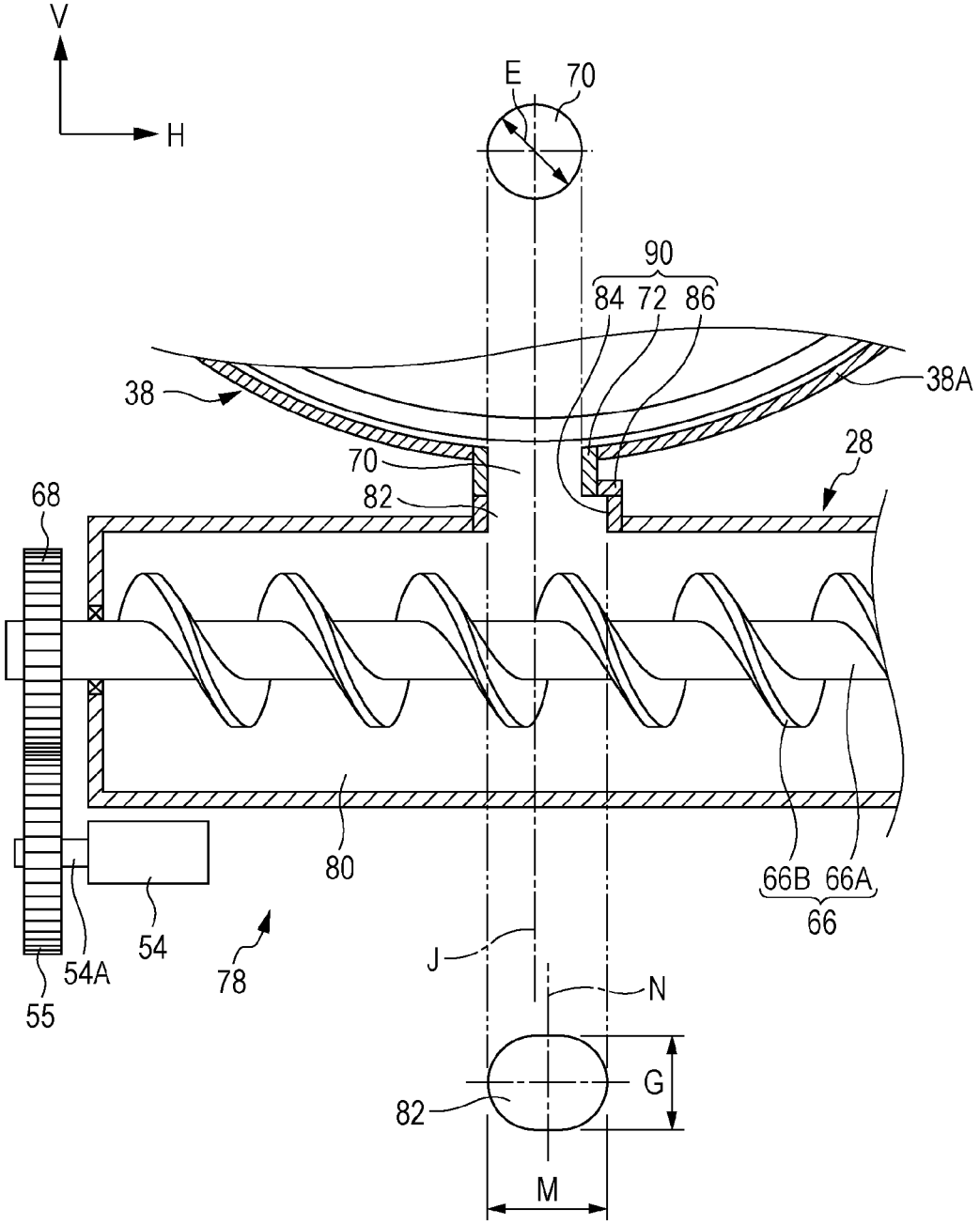
FIG. 3 is an enlarged sectional view illustrating an alternative example of the toner transport structure according to the exemplary embodiment of the present invention.

In a second example, as illustrated in FIG. 3, the dimension of the elongated (slot-shaped) inlet path 82 in the long side direction (in the intersecting direction, dimension M in FIG. 3) is set to 21.5 mm, and the center line N of the inlet path 82 is shifted from the center line J of the outlet path 70 toward the other end side (to the right side in FIG. 3) in the intersecting direction by 2.25 mm.

With such a structure, when seen in the vertical direction, with respect to the intersecting direction, an edge portion on the other end side of the exit of the path member 90 is disposed further toward the other end side than an edge portion on the other end side of the entrance of the path member 90.

In this state, when seen in the vertical direction, with respect to the intersecting direction, an edge portion on the one end side of the exit of the path member 90 is superposed with the edge portion on the one end side of the entrance of the path member 90.

Other specifications of the second example are similar to those of the first example.

Comparative Example

Figure 7:
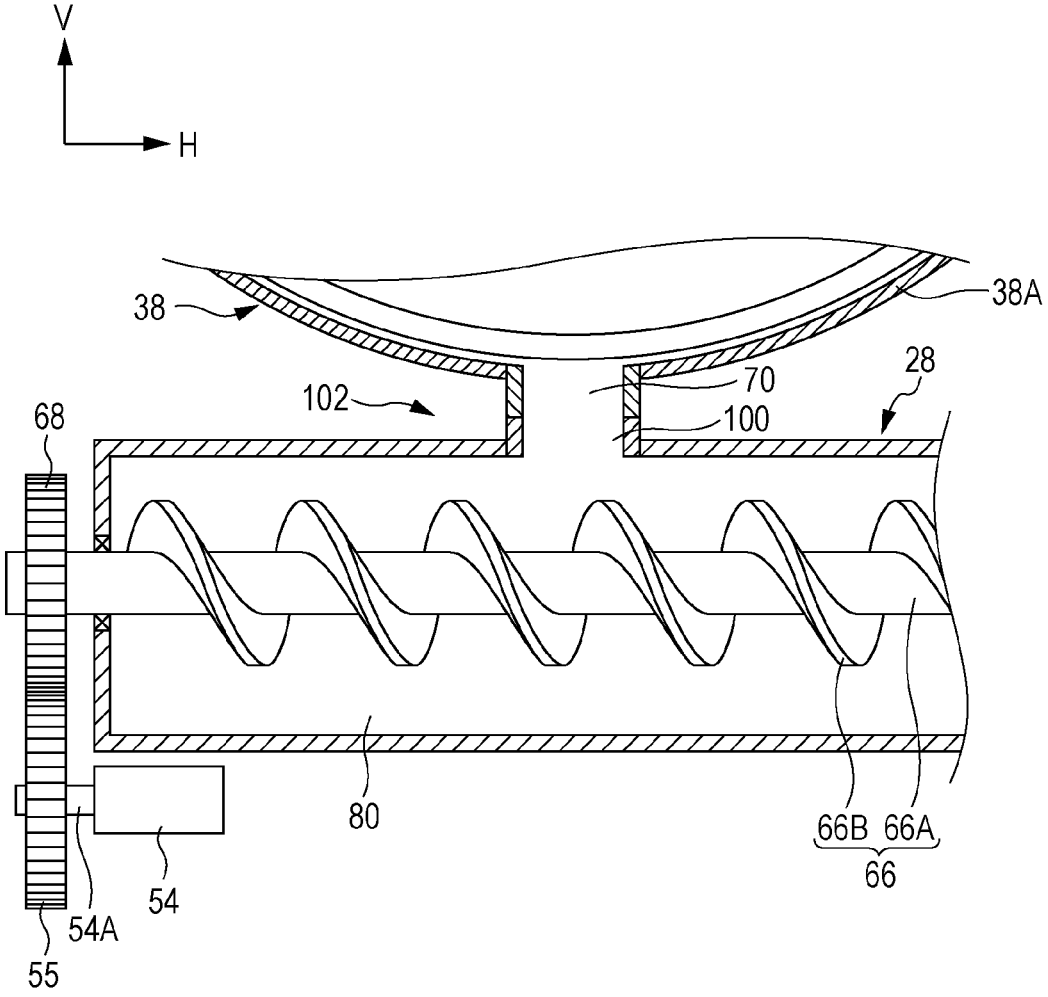
FIG. 7 is an enlarged sectional view of a toner transport structure, which is a comparative example in comparison with the toner transport structure according to the exemplary embodiment of the present invention.

Referring to FIG. 7, in the comparative example, an inlet path 100 has a circular shape similarly to the shape of the outlet path 70. Thus, a path member 102 is uniformly shaped from its entrance to exit. Other specifications of the comparative example are similar to those of the first example.

Method of Evaluation

A certain amount of the toner T is caused to enter the transport passage 80 through the entrance of the path members 90 or 102, and the amount of the toner T exiting the transport passage 80 on the other end side of the transport passage 80 is measured with respect to the passage of time.

Results of Evaluation

Figure 4A:
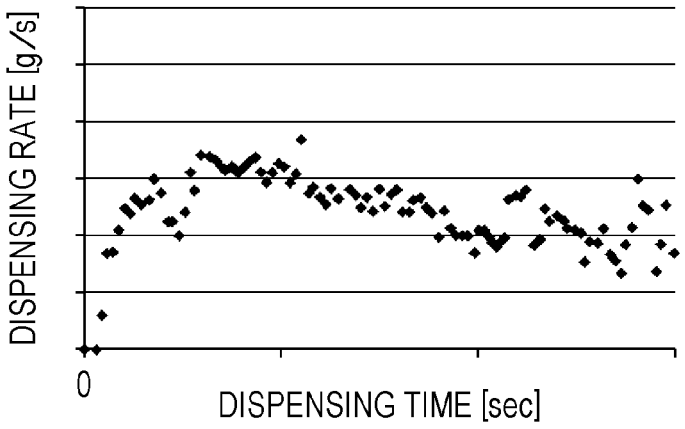
FIGS. 4A, 4B, and 4C are graphs illustrating results of evaluation of examples of the toner transport structure according to the exemplary embodiment of the present invention and a comparative example of a toner transport structure.
Figure 4B:
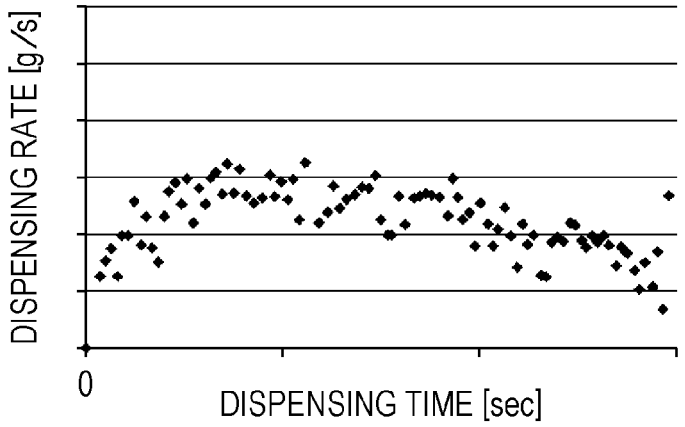
Figure 4C:
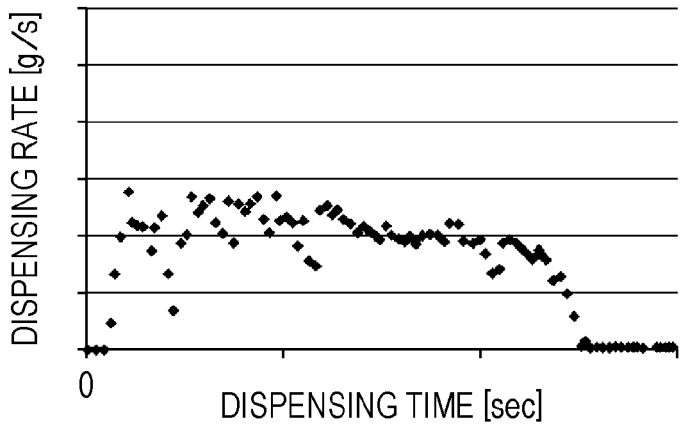

FIGS. 4A, 4B, and 4C are graphs that respectively illustrate the results of evaluation with the first example, the second example, and the comparative example.

In each of the graphs, the vertical axis indicates the amount per unit time of the toner T that exits the transport passage 80 on the other end side of the transport passage 80 (dispensing rate in grams per second or "g/s"). The amount per unit time of the toner T that exits the transport passage 80 on the other end side of the transport passage 80 increases as the position on the vertical axis moves up.

The horizontal axis of each graph indicates the passage of time (dispensing time) in seconds ("sec").

As illustrated in FIGS. 4A and 4B, in the first and second examples, the toner T still exits the transport passage 80 on the other end side of the transport passage 80 even after a certain period of time has passed. That is, it is observed that agglomeration of the toner T does not occur during transportation.

As illustrated in FIG. 4C, in the comparative example, the amount of the toner T that exits the transport passage 80 on the other end side of the transport passage 80 becomes 0 g/s after a certain period of time has passed. That is, it is observed that agglomeration of the toner T occurs during transportation.

As understood from the above-described results of evaluation, in the present exemplary embodiment, degradation of toner T transport performance is suppressed in the toner transport path in which the toner T transport direction is changed compared to the case where the areas of the openings of the entrance and the exit of the path member 90 are substantially the same.

In the present exemplary embodiment, the toner transport structure 78 is used in the toner transport path through which the toner T is supplied from the toner cartridge 38 to the developing device 32. The toner transport structure 78 according to the present exemplary embodiment may be used, for example, in a toner transport path, through which the toner T having been collected from the image carrying body 24 by the collection blade 36 is transported to a collection box (not shown).

In the case where a transfer belt is also used as an image carrying body that carries a toner image in addition to a so-called photoconductor drum, the toner transport structure 78 according to the present exemplary embodiment may be used in a toner transport path through which the toner T collected from the transfer belt is transported to the collection box (not shown).

Although the inner circumferential wall of the path member 90 is enlarged downward in a stepwise manner in the above-described embodiment, the inner circumferential wall of the path member may be enlarged so as to have an inverted funnel shape.

Although the intersecting direction extends in a direction similar to the apparatus width direction in the above-described embodiment, the intersecting direction may be a direction other than a direction that extends similarly to the apparatus width direction as long as the intersecting direction intersects the vertical direction.

In the above-described embodiment, although it is not particularly described, when detaching the toner cartridge 38 from the apparatus body 10A, in the path member 90, the step member 86 is separated from the inlet member 84. In addition, shutter members (not shown) are provided for the outlet path 70 and the inlet path 82. The shutter members close the outlet path 70 and the inlet path 82 when the toner cartridge 38 is detached from the apparatus body 10A.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner transport structure having a transport passage that extends in an intersecting direction that intersects a vertical direction, the toner transport structure comprising:

a path member that has an upper end and a lower end, an exit on a lower end side of the path member, and an entrance on an upper end side of the path member, the exit and the entrance having respective openings, the path member guiding toner downward in the vertical direction; and a transport member disposed in the transport passage connected to the exit on the lower end side of the path member, the transport member transporting along the transport passage the toner having been guided downward by the path member, wherein an area of the opening at the exit is larger than an area of the opening at the entrance, wherein the transport passage has one end and another end, and the transport member transports the toner from one end side toward another end side, and wherein the exit and the entrance have respective edge portions on the other end side of the transport passage, and the edge portion of the exit is disposed further toward the other end side than the edge portion of the entrance, wherein the exit and the entrance have respective edge portions on the one end side of the transport passage, and the edge portion of the exit is disposed further toward the one end side than the edge portion of the entrance or is disposed the one end side same as the edge portion of the entrance.

2. The toner transport structure according to claim 1, wherein the path member has an inner peripheral wall that is enlarged downward in a stepwise manner.

3. An image forming apparatus comprising:

the toner transport structure according to claim 1;

an image carrying body, an electrostatic latent image being formed on the image carrying body; and a developing member that develops the electrostatic latent image formed on the image carrying body into a toner image with the toner transported by the toner transport structure.

4. An image forming apparatus that forms an image on a transfer target material with toner, the image forming apparatus comprising:

an image carrying body that holds a toner image formed thereon;

a transfer member that transfers the toner image formed on the image carrying body onto the transfer target material;

a collection member that collects the toner that has not been transferred onto the transfer target material by the transfer member and remains on the image carrying body; and the toner transport structure according to claim 1 used to transport the toner collected by the collection member.

5. The toner transport structure according to claim 1, wherein the transport member comprises a spiral blade portion and the area of the opening at the exit is disposed directly above the spiral blade portion.

6. The toner transport structure according to claim 5, wherein the transport passage extends upstream and downstream of the opening at the exit.

* * * * *